US009269250B2

(12) United States Patent
Nickles et al.

(10) Patent No.: US 9,269,250 B2
(45) Date of Patent: Feb. 23, 2016

(54) IMMEDIATE RESPONSE SECURITY SYSTEM

(71) Applicants: Harry Nickles, O'Fallon, MO (US); Brad Corder, Dardenne Prairie, MO (US); Daryl Lueckenotte, High Ridge, MO (US); Jonathan Sanders, St. Louis, MO (US); Caleb Smith, Maryland Heights, MO (US)

(72) Inventors: Harry Nickles, O'Fallon, MO (US); Brad Corder, Dardenne Prairie, MO (US); Daryl Lueckenotte, High Ridge, MO (US); Jonathan Sanders, St. Louis, MO (US); Caleb Smith, Maryland Heights, MO (US)

( * ) Notice: Subject to any disclaimer, the term of this patent is extended or adjusted under 35 U.S.C. 154(b) by 149 days.

(21) Appl. No.: 14/213,689

(22) Filed: Mar. 14, 2014

(65) Prior Publication Data

US 2014/0266721 A1 Sep. 18, 2014

Related U.S. Application Data

(60) Provisional application No. 61/790,216, filed on Mar. 15, 2013.

(51) Int. Cl.
*G08B 13/00* (2006.01)
*G08B 21/02* (2006.01)

(52) U.S. Cl.
CPC ..... *G08B 21/02* (2013.01)

(58) Field of Classification Search
CPC ..... G08B 21/02; H04L 67/1095
USPC ..... 340/541, 551, 5.62, 5.74, 10.5
See application file for complete search history.

(56) References Cited

U.S. PATENT DOCUMENTS

| | | | | |
|---|---|---|---|---|
| 5,552,766 | A * | 9/1996 | Lee | E05G 5/003 109/3 |
| 7,703,996 | B1 * | 4/2010 | Sexton, Jr. | G03B 5/00 248/218.4 |
| 8,427,297 | B1 | 4/2013 | Markey et al. | |
| 2013/0057384 | A1 * | 3/2013 | Morris | H04L 67/1095 340/5.74 |

* cited by examiner

*Primary Examiner* — Tai T Nguyen
(74) *Attorney, Agent, or Firm* — Christopher L. E. Hines; Polsinelli PC

(57) ABSTRACT

Aspects of the present disclosure involve an intelligent and immediate response security system configured to provide continuous and immediate security data to requesting users in the event of a threat, potential threat, and/or the like. Additionally aspects of the present disclosure involve systems capable of initiating and performing various security commands to ensure the personal safety of individuals located within a certain type of facility, venue, location, etc.

20 Claims, 3 Drawing Sheets

IMMEDIATE RESPONSE SECURITY SYSTEM

CROSS REFERENCE TO RELATED APPLICATIONS

The present non-provisional utility application claims priority under 35 U.S.C. §119(e) to provisional application No. 61/790,216 entitled "Immediate Response Security System," filed on Mar. 15, 2013 and which is hereby incorporated by reference in its entirety.

TECHNICAL FIELD

Aspects of the present disclosure relate to surveillance, monitoring, and network security devices, and more particularly to physical facility security systems that adapt according to threat levels in a closed environment, such as an educational facility.

BACKGROUND

The use of security and surveillance systems in modern society is becoming ubiquitous. For example, surveillance cameras and related monitoring devices are generally used in many facilities to prevent criminal and/or otherwise undesirable activity, as well as provide safety and security for those within the facility. However, when high-risk situations such as shootings, hostage situations, or natural disasters occur, conventional monitoring systems may not provide relevant information to the appropriate authorities, and further, may not provide such authorities with immediate and efficient access to the monitored facilities. Moreover, the security of a facility, such as an elementary school or office building, may in part be dependent on preventing persons in possession of harmful objects, such as weapons and explosives, from entering the facility. Alternatively, in the case in which persons with harmful objects are already located inside the facility, the security of the facility may depend on a security system's ability to continuously locate, monitor, or otherwise contain such persons within the facility. Conventional monitoring systems are incapable of making such detections and/or determinations.

It is with these concepts in mind, among others, that various aspects of the present disclosure were conceived.

SUMMARY

Aspects of the present disclosure include systems, methods and/or computer readable mediums for a security system. A processor is configured to execute one or more instructions as a process and/or method to monitor a plurality of primary control modules communicatively connected to a facility system of a facility to determine whether a threat corresponding to the facility has been identified. The processor is further configured to, when a threat has been identified, initiate at least one security command to at least one primary control module of the plurality of primary control modules, and generate temporary login credentials corresponding to the security command and the facility.

BRIEF DESCRIPTION OF THE FIGURES

Aspects of the present disclosure may be better understood and its numerous objects, features, and advantages made apparent to those skilled in the art by referencing the accompanying drawings. It should be understood that these drawings depict only typical embodiments of the present disclosure and, therefore, are not to be considered limiting in scope.

DETAILED DESCRIPTION

Figure 1:
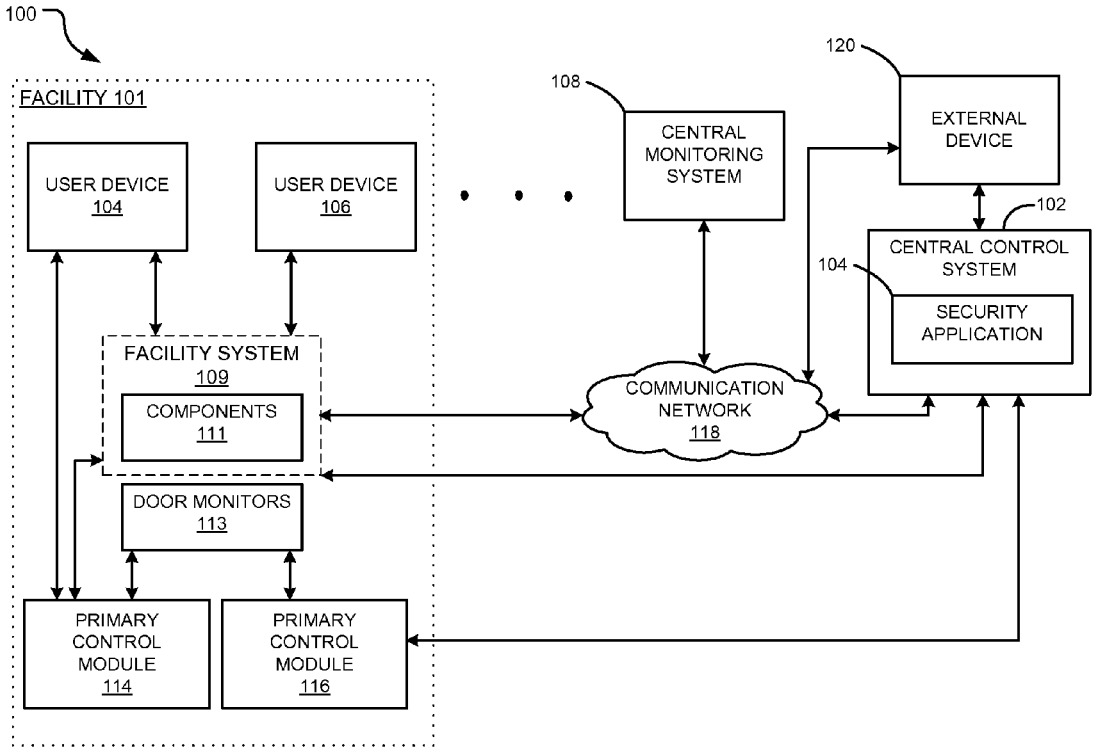
FIG. 1 is an illustration of a security system computing architecture, in accordance with one aspect of the present disclosure.

Aspects of the present disclosure involve systems and/or methods for continuously monitoring portions of a facility, such as a school, corporate office, convention center, stadium, and/or the like, to detect a threat or potential threat. In various aspects, a central control system, operating in conjunction with one or more primary control modules, may be provided as a part of a security system that enables users to transmit and receive security environment condition data corresponding to a facility (e.g., a physical building). The environment condition data may be processed and/or used to activate, deactivate, control, access, and/or otherwise manage various aspects of the facility in which the security system is currently employed to secure.

Security systems are commonly used to ensure the personal safety of individuals located within a certain type of facility, venue, location, and/or the like. Typically, these systems do so by generating an alarm in response to any number of events, such as unauthorized entry, fire, a medical emergency, or manual alarm activation. Thus, if the security alarm system generates an alarm, an alarm notification signal is transmitted via a hardwire and/or wireless communications link to a central station. Upon receiving the alarm notification signal, security service personnel at the central station may attempt to contact the client (i.e., the party at the secured location) to verify the alarm. If it is appropriate to do so, the security service personnel may, upon confirmation of the alarm, contact an emergency response agency (e.g., the police department, the fire department, or an emergency medical team).

When high-risk situations such as shootings, hostage situations, or natural disasters occur, however, such conventional monitoring systems may not provide the most relevant information to the appropriate authorities, and further, may not provide such authorities with immediate and efficient access to the facilities being monitored. Moreover, the security of a given facility, such as a school or office building, may in part be dependent on preventing persons in possession of harmful objects, such as weapons and explosives, from entering such facilities.

The security system of the present disclosure provides continuous and immediate security information and/or data to requesting users by providing environment condition data to users in real-time. Generally speaking, environment condition data includes any data describing a threat and/or potential threat of a facility, and may include various alarms, signals, images, sounds, multimedia, etc., providing evidence of the threat and/or potential threat. For example, environment condition data may include images depicting an intruder within a facility. Alternatively, environment condition data may include a recording of an alarm sounding at a threatened facility. In yet another example, environment condition data may include encrypted signals and/or messages received from various hardware and/or software components located within a facility and configured to sense and access threats and/or potential threats. The security system also enables the detection of harmful objects within a facility, such as educational facilities, corporate buildings, and/or the like. Various components of the physical facility (e.g., a school) such as doors, windows, ventilation spaces, etc., may be monitored, tracked, locked, and/or otherwise controlled by the security system to ensure the facility is safe during, for example, normal operating hours.

Figure 2:
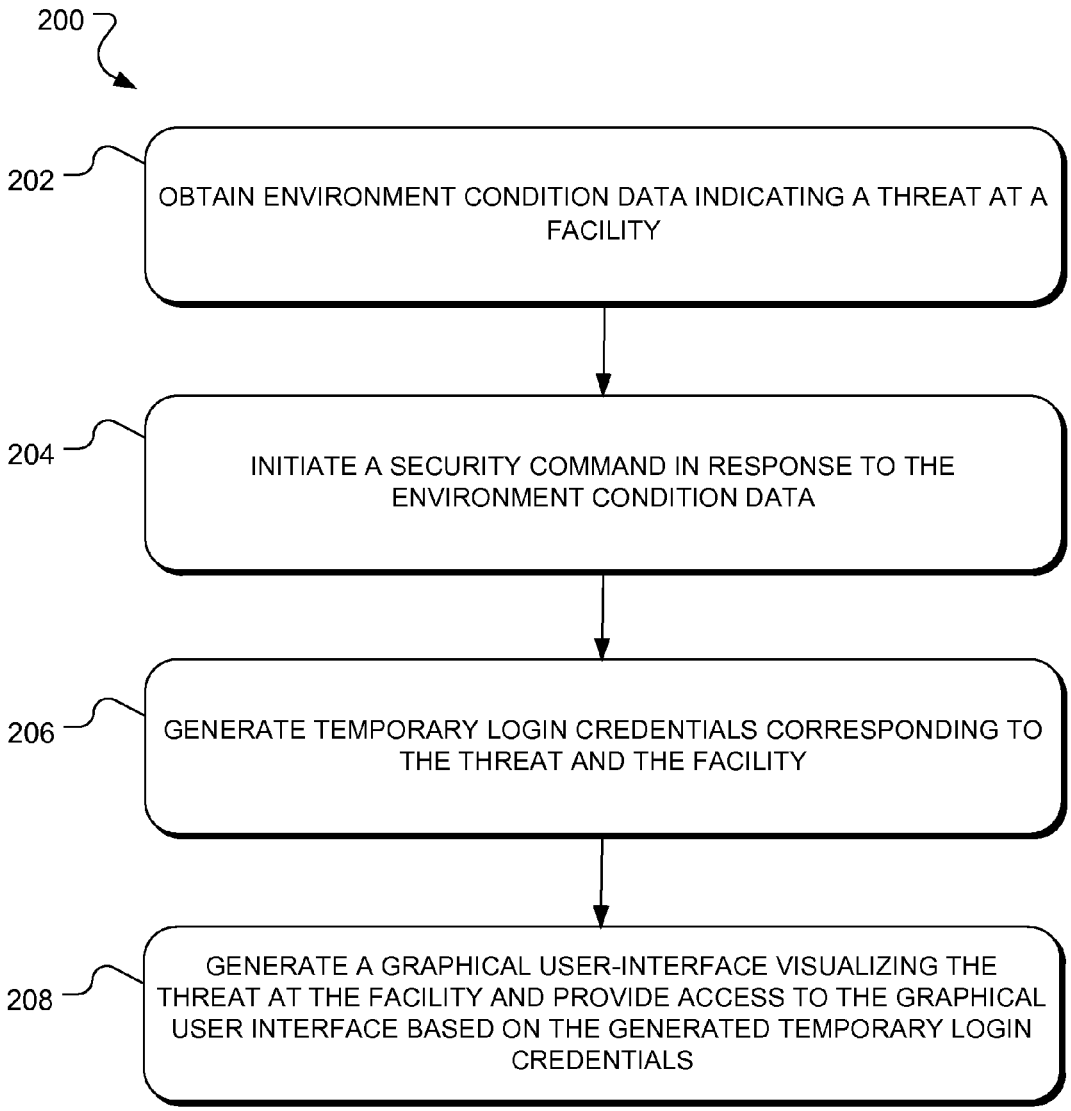
FIG. 2 is an illustration of a securing process, in accordance with one aspect of the present disclosure.

An illustrative process and/or system for monitoring and securing a facility, such as a physical school building, is depicted in FIGS. 1 and 2. In particular, FIG. 1 illustrates an example security system 100 containing various logical and/or physical components for monitoring a facility. FIG. 2 illustrates an example securing process 200 for automatically monitoring and securing the facility in the event of a threat and/or potential threat.

Referring initially to FIG. 1, the security system 100 includes various hardware and/or software components for monitoring, protecting and/or otherwise securing a facility 101, which may be, for example, a building (e.g., office building), educational facility (e.g., a school building such as an elementary school, middle school, high school, university campus building, facility, etc.), stadium, or other type of facility. As illustrated, one or more user devices (104-106), or alternatively a central monitoring system 108, may be accessed by a user interested in engaging in various security procedures at the facility 101 and/or otherwise receiving environment condition data related to the security of the facility 101. Such users may include, for example, authoritative figures, such as the police, school administrators, building security, the fire department, and/or the like.

Each of the one or more user devices (104-106) and/or the central monitoring system 108 may be a personal computer, work station, server, mobile device, mobile phone, tablet device, processor, and/or other processing device. Additionally, each of the one or more user devices (104-106) and/or the central monitoring system 108 may include one or more processors that process software or other machine-readable instructions, and may include a memory to store the software or other machine-readable instructions and data. Each of the one or more user devices (104-106) and/or the central monitoring system 108 may include a communication system to communicate via a wireline and/or wireless communication, such as through communications network 118, which may be the Internet, an intranet, an Ethernet network, a wireline network, a wireless network, a mobile communications network, and/or another communication network, and may further include a display (not shown) for viewing data, such as a computer monitor, and an input device (not shown) such as a keyboard or a pointing device (e.g., a mouse, trackball, pen, touch pad, or other device) for entering data and navigating through data, including exams, images, documents, structured data, unstructured data, HTML pages, other web pages, web forms, web application pages, and other data. While the user devices 104-106 are illustrated as being located within the facility 101, it is contemplated that such devices may be located elsewhere, external to the facility 101.

The one or more user devices (104-106) and the central monitoring system 108 may communicate with a central control system 102, which may be communicatively connected to a facility system 109 of the facility 101 to enable various security and/or monitoring mechanisms and/or procedures. The facility system 109 may include various computing components configured to enable access to the facility 101, communicate with the facility 101 (e.g., Internet and wireless communication connectivity) and/or operate the facility 101, and further, may include systems such as entertainment systems, broadcast systems, multimedia systems (video and digital content), and/or various other technological solutions used in the operations of the facility 101. Additionally, the facility system 109 may include various physical components, such as doors, windows, ventilation ducts, hallways, gates, cabinets, among others. In the illustrated embodiment, any one of such system is depicted as facility component(s) 111.

In one embodiment, the facility system 109 may include or otherwise be in operable communication with one or more primary control modules ("PCM") 114-116 that transmit and receive various signals in the form of commands (e.g., security commands) to and/or from the central control system 102. Each PCM 114-116 may include one or more processing devices, a microcontroller, power supply(s), relays, sensor(s) and related circuitry, timer(s), camera(s), switch(s), and/or the like, and may be connected to various locking mechanisms, such as electromagnetic or electromechanical lock(s). The processing device included within the PCM(s) 114-116 may be a single board computer processor, a programmable logic controller, or any type of programmable I/O device capable of monitoring inputs and performing logical processes and develop output functions. Each PCM 114-116 may be networked to the system using encryption communication protocols transmitting through conduits such as Ethernet TCP/IP or other standard communication protocols.

To monitor various aspects of the facility 101, each PCM 114-116 may include an array of sensors (not shown) and/or switches used to provide environment condition data corresponding to the facility 101 to the central monitoring system 102. The sensors may include sensing and activation circuitry which may be any combination of microphones or buzzers (speakers), an infrared/near infrared sensor such as a light dependent resistor (LDR) or photon detector or photodiode or photocell type sensor, glass break sensors such as audio detectors or shock detectors, or other sensors such as hall effect sensors, magnetic reed switches, proximity sensors, electromagnetic sensors and/or current sensors or transmitters, card readers, or RFID readers, etc. Alternatively, each PCM 114-116 may include manual sensors, such as a manual switch, or software switch, either of which may function as an emergency push button activated sensor.

The PCM(s) 114-116 may be communicatively connected to one or more door monitors 113. The door monitors 113 provide indications about doors within the facility 101, such as an indicator describing whether a door is locked, whether a room corresponding to the door is clear, and/or whether there is a medical emergency in the room located within the room corresponding to the door. Other status updates may also be detected in communications between the PCM(s) 114-116 and the door monitors 113. For example, in the context of a school shooting, the door monitors 113 may provide updates indicating a door is open, whether shots have been detected within a room corresponding to the door, and/or the like. The door monitors 113 may include sound and/or light detection hardware that logically compute and process thresholds to determine whether an incident has occurred. For example, if sound levels detected in an area by the door monitors 113 are determined to be above a certain threshold, a threat might be perceived. Additionally, if light levels detected in an area by the door monitors 113 are determined to be above a certain threshold (or otherwise satisfy the threshold), a threat might be perceived. The signals indicating the detection of a threat and/or potential threat may be sent in the form of a signal, such as a digital and/or analog signal to the PCM(s) 114-116. In one embodiment, the signals may be generated proportionally to the degree of perceived threat.

For example, if the threat is determined to be of a high risk level, a signal with a strength proportional to the risk level of the threat may be transmitted.

The door monitors 113 may include one or more processing devices or signaling devices, a microcontroller, power supply(s), relays, sensor(s) and related circuitry, timer(s), camera(s), switch(s), and/or the like and may be communicatively connected to the PCM(s) 114-116 and/or any other component of the security system 100.

Referring generally again to FIG. 1, the central control system 102 may be a server that includes one or more processors and memory and may execute various instructions, processes, functions, and/or applications, such as a security application 110, to enable the various security mechanisms and/or procedures. More specifically, the central control system 102 may query and collect environment condition data corresponding to the facility 101 from the PCM(s) 114-116 and process the environment condition data to determine whether a security status has changed at the facility 101, indicating a threat and/or a potential threat. For example, in the context of a school shooting event, the security application 110 may be executed by the central control system 102 to enable users, such as police or other authorities, to engage in various security procedures associated with the facility 101 and to receive and/or transmit security procedure-related data and/or information (e.g., environment condition data) to and/or from the user devices 104-106 and/or the central monitoring system 108, or elsewhere. In particular, the central control system 102 may generate various user interfaces, menus, dialogs, and/or other interactive components for display at the user devices (104-106) and/or the central monitoring system 108 that allow the user to engage in the various security procedures, such as door locking. The central control system 102 may transmit or otherwise communicate any identified threats to an external device 120, which may be some form of a dispatching service (e.g., 911 dispatch) associated with the police, the fire department, and/or the like. Although the central control system 102 is depicted as being a single server device, it is contemplated that the central control system 102 may include multiple servers, and may be integrated and/or otherwise implemented among multiple devices, such as in a cloud computing configuration. For example, the central control system 102 may be a combination of pre-defined Linux based commands, organized databases, and webservers that reside on one or more cloud data-servers.

Referring now to FIG. 2, the process 200 for automatically monitoring and/or securing a facility begins with obtaining environment condition data corresponding to a particular facility that indicates there is a perceived threat to the facility (operation 202). In one embodiment, the central control system may 102 may continuously query or otherwise monitor the PCMs 114-116 to obtain the environment condition data corresponding to the facility 101. More specifically, the control system 102 may continuously poll the PCM(s) 114-116 to obtain environment condition data indicating a threat or potential threat to the facility 101. The central control system 102 may process the obtained environment condition data to identify the threat and subsequently transmit one or more security commands back to the PCM(s) 114-116.

The PCM(s) 114-116 may determine a threat and/or potential threat via signals received from the door monitors 113, the facility components 111, and/or more generally the facility system 109. For example, the PCM(s) 114-116 may receive a geographical signal from the facility components 111 indicating that a person is in close proximity with the facility components 111, potentially causing a threat or risk. As another example, the PCM(s) 114-116 may receive a signal corresponding to a particular geographic location within the facility 101 indicating a threat or risk, such as if a person is detected as being located within a secured location of the facility 101. In yet another example, the PCM(s) 114-116 may receive a signal corresponding to an audio signal in conjunction with a geographic location signal within the facility 101, indicating a threat or risk.

In another embodiment, when the PCM(s) 114-116 determine that an emergency event, threat, and/or potential threat corresponding to the facility 101 has occurred, the PCM(s) 114-116 may automatically transmit the environment condition data indicating the threat to the central control system 102. Specifically, the PCM(s) 114-116 may actively monitor the facility component(s) 111 to detect various signals indicating a potential threat, such as an alarm, and provide for example an indication of the alarm and/or other environment condition data indicating the threat to the control system 102 when the signal is detected or otherwise received. For example, the PCM(s) 114-116 may communicate with the door monitors 113 to determine a threat. When the PCM(s) 114-116 have detected a threat and/or potential threat, the PCM(s) 114-116 may transmit an encrypted message describing the threat and/or potential threat to the central control system 102. The central control system 102 then initiates the proper pre-defined tasks based on the message received.

In response to receiving facility environment condition data identifying a threat and/or potential threat, a security command is initiated (operation 204). Specifically, the central control system 102 may transmit one or more security commands to the PCM(s) 114-116, which may cause the PCM(s) 114-116 to execute one or more actions at the facility 101. For example, the central control system 102 may transmit a logging security command to the PCM(s) 114-116 and in response, the PCM(s) 114-116 may change the logging location of environment condition data corresponding to the facility 101 from a local database (i.e., local to the PCM(s) 114-116) to a database corresponding to the central control system 102, causing all logging of environment condition data corresponding to the facility 101 to be maintained at the central control system 102. In one embodiment, the logging change may occur instantaneously, or in near real-time. In another embodiment, the logging change may occur at the same time the PCM(s) 114-116 determine a threat (simultaneously).

In another example, the central control system 102 may transmit a lockdown security command to the PCM(s) 114-116. Upon receipt of the lockdown command, the PCM(s) 114-116 may perform a lockdown procedure at the facility 101 for a pre-determined time by energizing or de-energizing relay(s) to engage/disengage locks associated with doors, windows, and/or other barriers within the facility 101. For example, the PCM(s) 114-116 may energizing/de-energize transistors or relay(s) to turn status lights on or off in the facility 101.

In yet another example, the central control system 102 may transmit a play local audio file security command to the PCM(s) 114-116 and in response, the PCM(s) 114-116 may trigger the facility components 111 to activate various audio, video, and/or multimedia signals throughout the facility 101 symbolizing the occurrence of a security breach, threat, etc. For example, the PCM(s) 114-116 may trigger an audio alarm to anyone located within the facility 101 to exit the premises. Other security commands may include a notification of the threat and/or perceived threat being transmitted to the external system (e.g., the external device 120), such as for example to a third party security agency, school administrators, and the like. Security commands may include a command to initiate various environmental condition procedures corresponding to the facility 101, such as for example a command to shut off water, activate/deactivate heat, and the like. In one embodiment, the security command may automatically initiate the facility components 111, or more generally portions of the facility system 109, to engage in various security locking, communication, and testing procedures in response to the threat.

In addition to initiating a security command, temporary login credentials may be generated that correspond to the identified threat and/or potential threat and the facility (operation 206). For example, in one embodiment, the central control system 102 may generate the temporary login credentials, such as for example a username and password, and optionally, store the temporary login credentials in a secure database that is located and managed remotely, such as for example with a cloud computing architecture. The central control system 102 may securely transmit (e.g., encrypted transmission) the temporary login credentials to a concerned party, such as for example, to the external device 120 when a threat at the facility 101 has been determined. For example, the central control system 102 may transmit the temporary login credentials to a 911 dispatch call center, a fire department, a police station, a security company associated with the facility 101, etc.

In addition to initiating a security command, one or more graphical user-interfaces may be generated that visualize the identified threat and/or potential threat at the facility (operation 208). For example, the central control system 102 may generate various graphical user-interfaces including menus, dialogs, and/or other interactive components that correspond to the identified threat at the facility 101, such as for example, generating a map or floor-plan of the facility 101 illustrating the various facility components 111, the PCM(s) 114-116, and the door monitors 113, and their respective involvement in the perceived threat. For example, the generated interfaces may visually indicate the specific door or room corresponding to the threatened door via the displayed door monitor 113. Additionally, the generated interfaces may include visual data indicating the operational state of the displayed facility components 111, the PCM(s) 114-116, and the door monitors 113. For example, various colors such as red, yellow, and green, may be displayed or otherwise associated with the door monitors 113 to indicate that the door monitors 113 are disabled, unlocked, or locked, respectively, or that PCM(s) 114-116 are responding, disabled, or malfunctioning. In one embodiment, the control system 102 may designate a different PCM 114-116 as a lead PCM to and from which all security commands must be transmitted, such as for example, when a PCM 114-116 is identified as being disabled or malfunctioning.

To access the generated graphical user-interfaces, the control system 102 may authenticate the temporary login credentials. The generated graphical user-interfaces may be updated in real-time, or at some specific time interval, by the control system 102 with environment condition data corresponding to the facility 101. Further, security commands may be initiated using the generated graphical user-interfaces. Other commands and/or messages (e.g., pre-recorded phone messages, emails, or text messages) may be transmitted, such as emergency notifications, to pre-determined devices.

Thus, as described above, aspects of the present disclosure involve an intelligent and immediate response security system configured to provide continuous and immediate security data to requesting users in the event of a threat, potential threat, and/or the like. Additionally aspects of the present disclosure involve systems capable of initiating and performing various security commands to ensure the personal safety of individuals located within a certain type of facility, venue, location, and/or the like.

Figure 3:
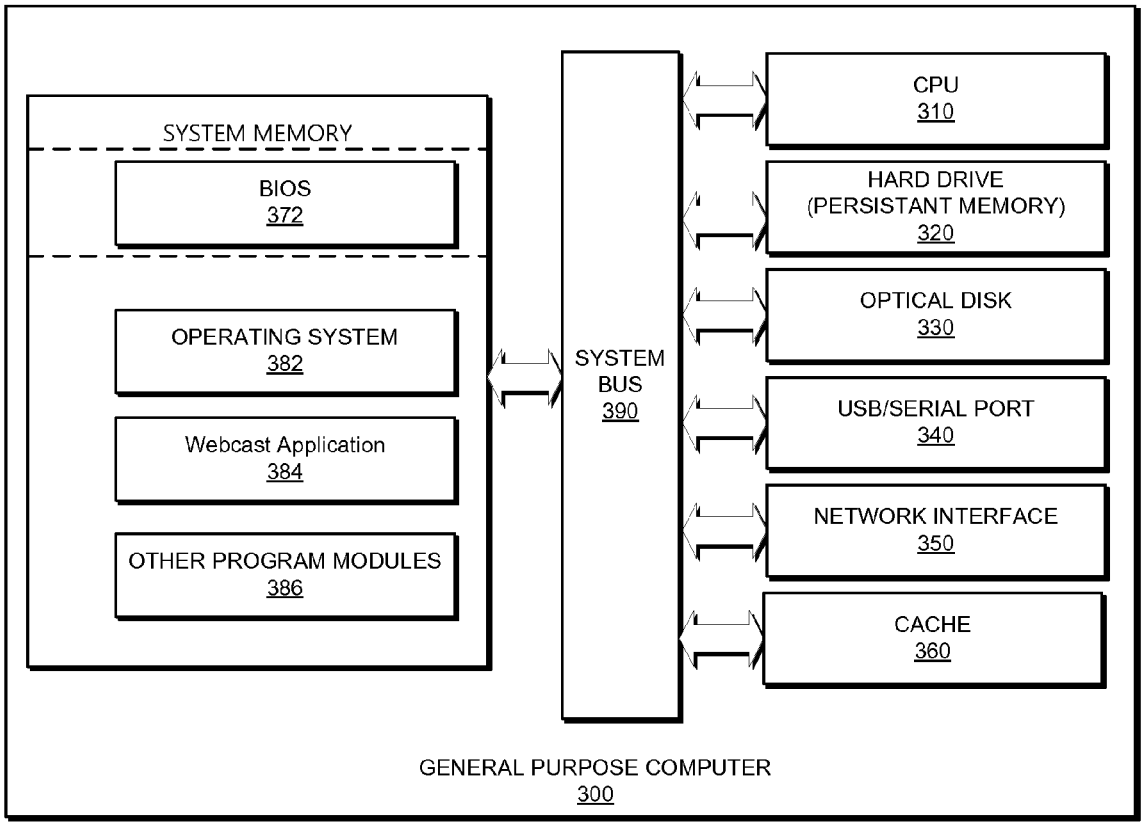
FIG. 3 is an illustration of an example computing device, in accordance with one aspect of the present disclosure.

FIG. 3 illustrates an example general purpose computer 300 that may be useful in implementing the described systems (e.g., the control system 102). The example hardware and operating environment of FIG. 3 for implementing the described technology includes a computing device, such as a general purpose computing device in the form of a personal computer, server, or other type of computing device. In the implementation of FIG. 3, for example, the general purpose computer 300 includes a processor 310, a cache 360, a system memory 320, and a system bus 390 that operatively couples various system components including the cache 360 and the system memory 320 to the processor 310. There may be only one or there may be more than one processor 310, such that the processor of the general purpose computer 300 comprises a single central processing unit (CPU), or a plurality of processing units, commonly referred to as a parallel processing environment. The general purpose computer 300 may be a conventional computer, a distributed computer, or any other type of computer; the disclosure included herein is not so limited.

The system bus 390 may be any of several types of bus structures including a memory bus or memory controller, a peripheral bus, a switched fabric, point-to-point connections, and a local bus using any of a variety of bus architectures. The system memory may also be referred to as simply the memory, and includes read only memory (ROM) and random access memory (RAM). A basic input/output system (BIOS) containing the basic routines that help to transfer information between elements within the general purpose computer 300, such as during start-up, may be stored in ROM. The general purpose computer 300 further includes a hard disk drive 320 for reading from and writing to a persistent memory such as a hard disk (not shown) and an optical disk drive 330 for reading from or writing to a removable optical disk such as a CD ROM, DVD, or other optical medium.

The hard disk drive 320 and optical disk drive 330 are connected to the system bus 390. The drives and their associated computer-readable medium provide non-volatile storage of computer-readable instructions, data structures, program engines and other data for the general purpose computer 300. It should be appreciated by those skilled in the art that any type of computer-readable medium which can store data that is accessible by a computer, such as magnetic cassettes, flash memory cards, digital video disks, random access memories (RAMs), read only memories (ROMs), and the like, may be used in the example operating environment.

A number of program engines may be stored on the hard disk, optical disk, or elsewhere, including an operating system 382, an application 384, and one or more other application programs 386. A user may enter commands and information into the general purpose computer 300 through input devices such as a keyboard and pointing device connected to the USB or Serial Port 340. These and other input devices are often connected to the processor 310 through the USB or serial port interface 340 that is coupled to the system bus 390, but may be connected by other interfaces, such as a parallel port. A monitor or other type of display device may also be connected to the system bus 390 via an interface (not shown). In addition to the monitor, computers typically include other peripheral output devices (not shown) such as speakers and printers.

The embodiments of the present disclosure described herein are implemented as logical steps in one or more computer systems. The logical operations of the present disclosure are implemented: (1) as a sequence of processor-implemented steps executing in one or more computer systems; and (2) as interconnected machine or circuit engines within one or more computer systems. The implementation is a matter of choice, dependent on the performance requirements of the computer system implementing aspects of the present disclosure. Accordingly, the logical operations making up the embodiments of the disclosure described herein are referred to variously as operations, steps, objects, or engines. Furthermore, it should be understood that logical operations may be performed in any order, unless explicitly claimed otherwise or a specific order is inherently necessitated by the claim language.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the disclosure and are thus within the spirit and scope of the present disclosure. From the above description and drawings, it will be understood by those of ordinary skill in the art that the particular embodiments shown and described are for purposes of illustrations only and are not intended to limit the scope of the present disclosure. References to details of particular embodiments are not intended to limit the scope of the disclosure.

What is claimed is:

1. A security system comprising:

a plurality of primary control modules communicatively connected to:

at least one door monitor for monitoring a door of a facility; and a facility system associated with the facility; and at least one processor to:

monitor the plurality of primary control modules to determine whether respective primary control modules of the plurality of primary control modules are signaling a threat corresponding to the facility, wherein the respective primary control modules of the plurality of primary control modules signal a threat when the at least one door monitor provides a signal indicating the door is unsecure; and when a threat has been signaled:

initiate at least one security command to at least one primary control module of the plurality of primary control modules;

generate temporary login credentials corresponding to the security command and the facility; and transmit the temporary login credentials to an external system for presentation to a user.

2. The system of claim 1, wherein the facility is a physical facility comprising a plurality of components and wherein the at least one processor is further configured to automatically secure at least one component of the plurality of components in response to the identified threat.

3. The system of claim 2, wherein each primary control module of the plurality of primary control modules comprises at least one sensor configured to provide environment condition data identifying the threat to the at least one processor, the environment data corresponding to the facility.

4. The system of claim 3, wherein the facility is a physical school building, wherein the plurality of components include a plurality of doors, wherein the at least one sensor is a digital camera providing a digital signal, and wherein the at least one security command is a lockdown command that automatically secures the plurality of doors included in the facility for a period of time.

5. The system of claim 1, wherein the at least one processor is included in a central control system remotely located from the facility and wherein the at least one processor is further configured to instruct the plurality of primary control modules to log the environment data to a secured database associated with the central monitoring system when the threat has been identified.

6. The system of claim 1, wherein the at least one processor is further configured to:

after the temporary login credentials are authenticated, generate for display at the external system at least one graphical user-interface visualizing the plurality of control modules, the facility system, and results of the at least one security command.

7. The system of claim 6, wherein the external system is a dispatching service and wherein the graphical user-interface includes an interactive map of the facility visualizing the plurality of control modules, the facility, and the results of the at least one security command.

8. The system of claim 7, wherein the temporary login credentials include a username and password, wherein the temporary login credentials are stored in a secured database, and wherein the at least one processor is further configured to transmit an indication of the threat to the external service.

9. A method for securing a facility comprising:

monitoring, using at least one processor, a plurality of primary control modules communicatively connected to a facility system corresponding to a facility to determine whether respective primary control modules of the plurality of primary control modules are signaling a threat corresponding to the facility, wherein the respective primary control modules signal a threat when at least one door monitor, configured to monitor a door of the facility, provides a signal indicating the door is unsecure; and when a threat has been signaled:

initiating, using that least one processor, at least one security command to at least one primary control module of the plurality of primary control modules;

generating temporary login credentials corresponding to the security command and the facility; and transmitting the temporary login credentials to an external system.

10. The method of claim 9, wherein the facility is a physical facility comprising a plurality of components and wherein the at least one processor is further configured to automatically secure at least one component of the plurality of components in response to the identified threat.

11. The method of claim 10, wherein each primary control module of the plurality of primary control modules comprises at least one sensor configured to provide environment condition data identifying the threat to the at least one processor, the environment data corresponding to the facility.

12. The method of claim 11, wherein the facility is a physical school building, wherein the plurality of components include a plurality of doors, wherein the at least one sensor is a digital camera providing a digital signal, and wherein the at least one security command is a lockdown command that automatically secures the plurality of doors included in the facility for a period of time.

13. The method of claim 9, wherein the at least one processor is included in a central control system remotely located from the facility and wherein the at least one processor is further configured to instruct the plurality of primary control modules to log the environment data to a secured database associated with the central monitoring system when the threat has been identified.

14. The method of claim 9, wherein the at least one processor is further configured to:

after the temporary login credentials are authenticated, generate for display at the external system, at least one graphical user-interface visualizing the plurality of control modules, the facility system, and results of the at least one security command.

15. The method of claim 14, wherein the external system is a dispatching service and wherein the graphical user-interface includes an interactive map of the facility visualizing the plurality of control modules, the facility, and the results of the at least one security command.

16. The method of claim 15, wherein the temporary login credentials include a username and password, wherein the temporary login credentials are stored in a secured database, and wherein the at least one processor is further configured to transmit an indication of the threat to the external service.

17. A security system comprising:

at least one processor to:

monitor a plurality of primary control modules communicatively connected to a facility system of a facility to determine whether a threat corresponding to the facility has been identified; and when a threat has been identified:

initiate a first security command to at least one primary control module of the plurality of primary control modules; and generate temporary login credentials corresponding to the security command and the facility;

authenticate the temporary login credentials at a user device; and after the temporary login credentials are authenticated, generate for display at the user device, at least one graphical user-interface visualizing the plurality of control modules, the facility system, and results of the first security command.

18. The system of claim 17, wherein each primary control module of the plurality of primary control modules comprises at least one sensor configured to provide environment condition data containing the threat to the at least one processor, the environment data corresponding to the facility.

19. The system of claim 18, wherein the facility is a physical school building, wherein the plurality of components include a plurality of doors, wherein the at least one sensor is a digital camera providing a digital signal, and wherein the at least one security command is a lockdown command that automatically secures the plurality of doors included in the facility for a period of time.

20. The system of claim 17, wherein the at least one processor is included in a central control system remotely located from the facility and wherein the at least one processor is further configured to instruct the plurality of primary control modules to log the environment data to a secured database associated with the central monitoring system when the threat has been identified.

* * * * *